US008484933B2

(12) United States Patent
Schmidt et al.

(10) Patent No.: US 8,484,933 B2
(45) Date of Patent: Jul. 16, 2013

(54) METHOD AND APPARATUS FOR PACKING A MATERIAL IN A PACKING CONTAINER

(75) Inventors: Siegfried Schmidt, Verden-eitze (DE); Johannes P. Schlebusch, Thedinghausen (DE)

(73) Assignee: Mars, Inc., McLean, VA (US)

( * ) Notice: Subject to any disclaimer, the term of this patent is extended or adjusted under 35 U.S.C. 154(b) by 58 days.

(21) Appl. No.: 12/671,621

(22) PCT Filed: Aug. 5, 2008

(86) PCT No.: PCT/EP2008/006413

§ 371 (c)(1), (2), (4) Date: Feb. 1, 2010

(87) PCT Pub. No.: WO2009/018990

PCT Pub. Date: Feb. 12, 2009

(65) Prior Publication Data

US 2011/0225931 A1 Sep. 22, 2011

(30) Foreign Application Priority Data

Aug. 7, 2007 (DE) ..... 10 2007 037 606

(51) Int. Cl.
*B65B 31/00* (2006.01)

(52) U.S. Cl.
USPC ..... 53/407; 53/86; 53/425; 53/432; 53/434; 53/512

(58) Field of Classification Search
USPC ..... 53/86, 89, 90, 110, 127, 407, 425, 53/456, 432, 433, 434, 440, 510, 511, 512
See application file for complete search history.

(56) References Cited

U.S. PATENT DOCUMENTS

| | | | | |
|---|---|---|---|---|
| 2,514,027 | A * | 7/1950 | Clifcorn et al. | 426/399 |
| 2,524,560 | A * | 10/1950 | Cote | 141/12 |
| 3,336,722 | A * | 8/1967 | Van Der Winden | 53/426 |
| 3,468,102 | A * | 9/1969 | Farrar et al. | 53/385.1 |
| 3,486,295 | A * | 12/1969 | Tuma et al. | 53/89 |
| 3,606,997 | A * | 9/1971 | Guckel | 422/26 |
| 3,972,153 | A | 8/1976 | Kiellarson et al. | |
| 4,081,942 | A * | 4/1978 | Johnson | 53/407 |
| 4,495,974 | A | 1/1985 | Pohorski | |

(Continued)

FOREIGN PATENT DOCUMENTS

| | | | |
|---|---|---|---|
| CH | 470999 | A | 4/1969 |
| DE | 19901355 | A1 | 7/2000 |

(Continued)

OTHER PUBLICATIONS

International Search Report and Written Opinion mailed Aug. 5, 2008 in PCT/EP2008/006413.

*Primary Examiner* — M. Alexandra Elve
*Assistant Examiner* — Eyamindae Jallow
(74) *Attorney, Agent, or Firm* — Fulbright & Jaworski LLP

(57) ABSTRACT

The present invention relates to a method for packing a material in a packing container. The method includes the steps of providing a gaseous atmosphere with superheated steam in a housing; supplying a material to the gaseous atmosphere and delivering a packing container to the gaseous atmosphere. Thereafter, the material is filled into the packing container, the packing container is sealed inside the gaseous atmosphere, and filled packing container is moved out of the gaseous atmosphere.

28 Claims, 16 Drawing Sheets

U.S. PATENT DOCUMENTS

| | | | | | |
|---|---|---|---|---|---|
| 4,533,515 | A | * | 8/1985 | Witter et al. | 422/26 |
| 4,543,263 | A | * | 9/1985 | Goldhahn | 426/520 |
| 4,885,897 | A | * | 12/1989 | Gryouda et al. | 53/407 |
| 4,942,717 | A | * | 7/1990 | Kozub | 53/428 |
| 5,711,086 | A | * | 1/1998 | Stubbing | 34/77 |
| 7,444,795 | B2 | * | 11/2008 | Yasuhira | 53/403 |
| 7,631,476 | B2 | * | 12/2009 | Yasuhira et al. | 53/434 |
| 2002/0134051 | A1 | * | 9/2002 | Kurth | 53/425 |
| 2009/0217626 | A1 | * | 9/2009 | Kemp et al. | 53/407 |

FOREIGN PATENT DOCUMENTS

| | | | | |
|---|---|---|---|---|
| EP | 0749897 | A | | 12/1996 |
| EP | 749897 | A1 | * | 12/1996 |
| EP | 0899195 | A1 | | 3/1999 |
| GB | 527011 | A | | 10/1940 |
| GB | 655851 | A | | 8/1951 |
| GB | 669319 | A | | 4/1952 |
| GB | 832595 | A | | 4/1960 |
| WO | WO-93/04930 | A1 | | 3/1993 |

* cited by examiner

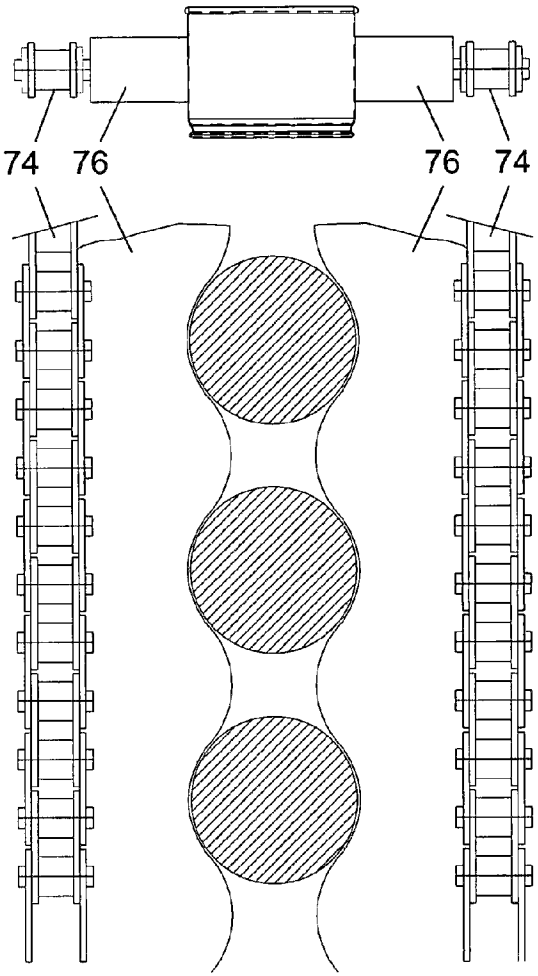
Fig. 13
Fig. 14
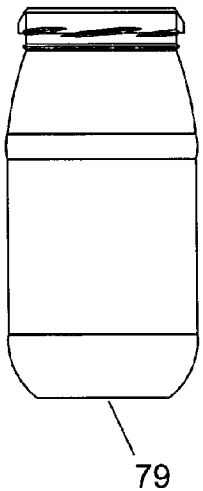
Fig. 12b
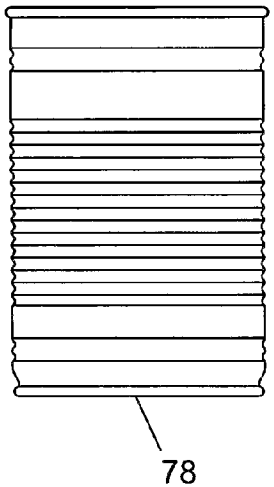
Fig. 12a

METHOD AND APPARATUS FOR PACKING A MATERIAL IN A PACKING CONTAINER

CROSS-REFERENCE TO RELATED APPLICATIONS

This application is a national stage filing of PCT/EP2008/006413 filed Aug. 5, 2008, claiming priority from Application DE 10 2007 037 606.7 filed on Aug. 7, 2007.

TECHNICAL FIELD

The invention relates to a method and an apparatus for packing a material, especially a food product, in a packing container.

BACKGROUND OF THE INVENTION

When a food product is packed in a packing container, it is usually desired to work with as few germs as possible, or indeed under sterile conditions, so that the packed product can be stored for a certain minimum storage time without any germs, bacteria or other micro-organisms that might be present inside the packing causing the product to spoil as a result of their proliferation.

In practice, various approaches are known for this purpose. For example, the food product and/or the packing container may be subjected to an inert, sterile and/or bactericidal protective gas or bactericidal radiation before the packing process, though this entails certain disadvantages and, in many cases, a considerable amount of complex technical apparatus, without it being reliably possible to achieve sterile or virtually sterile packing in every case.

The invention is based on the problem of creating a method and an apparatus for packing a material in a packing container with which, to the greatest possible extent, sterile packing can be achieved without excessive design or process engineering effort.

BRIEF SUMMARY OF THE INVENTION

From the point of view of process engineering, this problem is solved by a method for packing a material in a packing container, comprising the steps of providing a gaseous atmosphere with superheated steam in a housing, supplying a material to the gaseous atmosphere, delivering a packing container to the gaseous atmosphere, filling the material into the packing container, sealing the packing container, and moving the filled and sealed packing container out of the gaseous atmosphere.

It is preferable that the temperature of the gaseous atmosphere should be more than 100° C., 120° C., 140° C., 160° C. or 180° C., at least in a horizontal sub-layer. The gaseous atmosphere may be at ambient pressure or at an elevated or reduced pressure.

The gaseous atmosphere is conveniently a mixture of a first component, consisting of air and/or another gas, and water vapour as a second component, and has a steam content, at least in a horizontal sub-layer, of at least 50% by weight, 60% by weight, 70% by weight, 80% by weight, 90% by weight, 95% by weight, 98% by weight or 99% by weight, or consists only of steam.

It may be provided that the material is dried for a certain time before packing by dwelling in the gaseous atmosphere for a predetermined period of time.

The material can be packed in a tin or a screw-topped jar or in a film bag or pouch pack. In the latter case, it can be provided that the pouch pack is formed, filled and sealed inside the gaseous atmosphere, starting from a web of film, by means of a forming, filling and sealing apparatus.

From the apparatus point of view, the problem of the invention is solved by an apparatus for packing a material in a packing container, comprising a housing for holding a gaseous atmosphere with superheated steam, the housing having an inlet port and an outlet port, a means for generating a gaseous atmosphere with superheated steam inside the housing, a first transport means for transporting the material through the inlet port into the housing and to a packing apparatus, the material being packed in a packing container by the packing apparatus, and a second transport means for transporting the material from the packing apparatus through the outlet port and out of the housing.

In this context, it is proposed that the first and second transport means may be independent of one another or formed by part-sections of one and the same transport means.

The inlet port can be on the same level as the outlet port.

It can be provided that the inlet port is disposed at a free end of an inlet duct or guide channel which extends downwards from the housing.

It can correspondingly be provided that the outlet port is disposed at a free end of an outlet duct or guide channel which extends downwards from the housing.

It can be provided that a vent line communicates with the housing and has an exit aperture at a height below the housing and above the inlet port.

It is conveniently proposed that there is an extraction line communicating with the housing and conducted via a fan to a condenser.

It can be advantageous for the first transport means to support steam-permeable trays in which the material to be packed is held.

Disposed along a partial section of the first transport means, there may be a conduit subjected to over-pressure or under-pressure, which communicates with a lower portion of the housing.

In this context, a flow guide or sealing means may be disposed between the conduit and the partial section of the first transport means in order to ensure that there is a flow through the transport means, especially the trays.

The packing apparatus can be designed as a forming, filling and sealing apparatus for pouches or film bags or as a filling and sealing apparatus for tins or jars.

BRIEF DESCRIPTION OF THE DRAWINGS

Further advantages and features of the invention will become apparent from the following description of various working embodiments, reference being made to a drawing, in which:

FIGS. 12*a* and FIG. 12*b* show side views of a tin or screw-topped jar as further variants of packing containers;

FIG. 13 shows a view of a different transport means in the direction of transport;

FIG. 14 shows a plan view of a section of the transport means according to FIG. 13 with packing containers held on it;

DETAILED DESCRIPTION OF THE INVENTION

Figure 1:
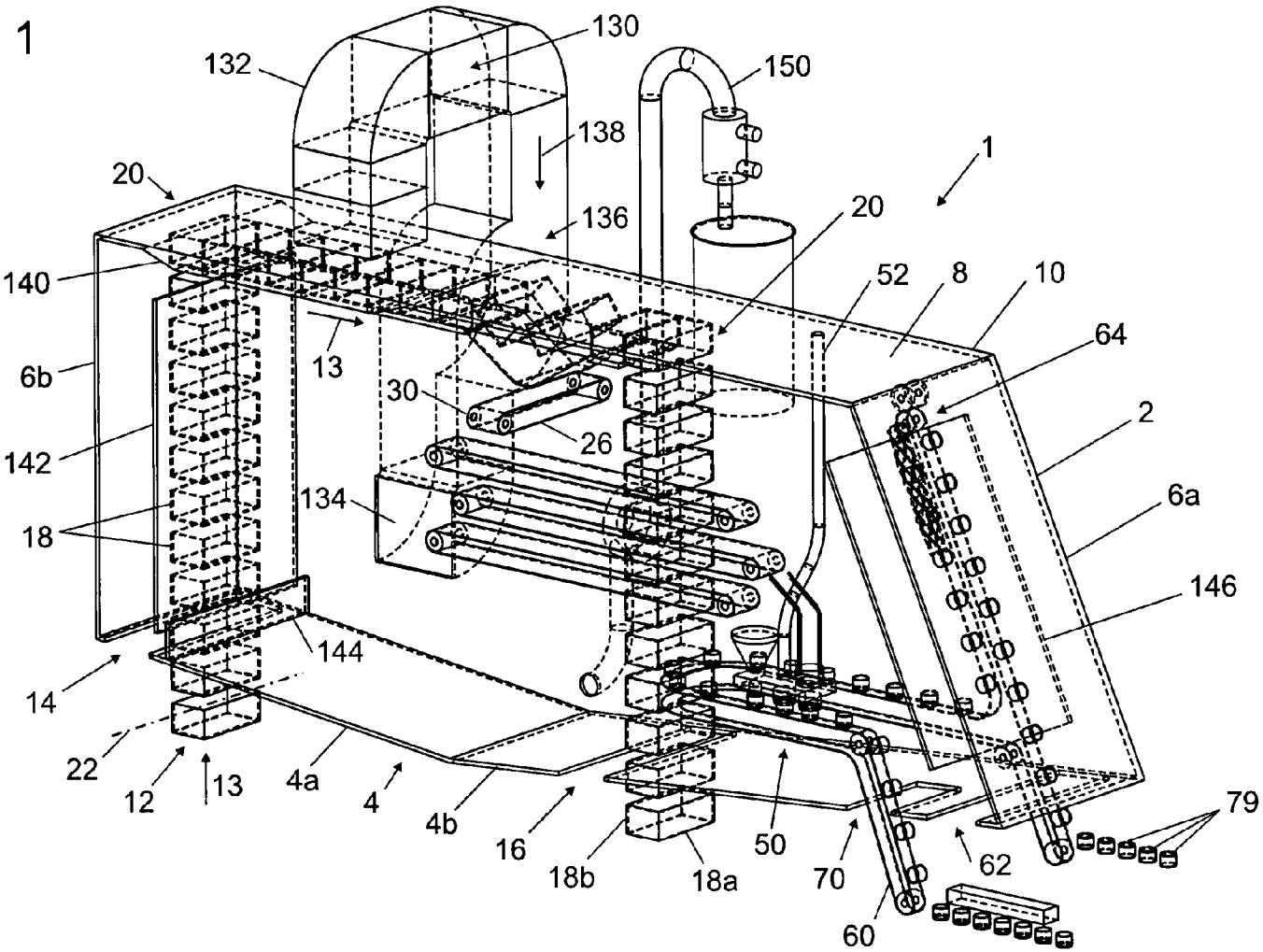
FIG. 1 shows a schematic perspective view of a first embodiment of an apparatus in accordance with the invention.

Referring now to FIGS. 1 to 4, first of all a first embodiment of an apparatus in accordance with the invention for packing a material, especially a food product, indicated as a whole by 1, is explained.

The apparatus 1 consists first of a housing 2 with a bottom wall 4, a right-hand side wall 6*a*, a left-hand side wall 6*b*, a rear wall 8, a corresponding front wall, not shown, and a top wall 10. Incorporated in the bottom wall 4 are a series of apertures for the transport means, which are still to be explained, to pass through. The bottom wall 4 is disposed substantially horizontally and consists, in the embodiment shown, of two bottom wall parts 4*a*, 4*b* positioned so as to slope slightly towards one another in a V-shape. The purpose of this arrangement is to allow condensate to flow to the connecting or transition area between the two bottom wall parts 4*a*, 4*b*, which forms the lowest point of the interior space of the housing.

The front wall, not shown, is substantially parallel to the rear wall 8 and abuts the lateral edges of the upper wall, the side walls and the bottom wall in such a manner as to create a seal, so that, apart from the apertures in the bottom wall 4, the housing 2 surrounds an interior space which is enclosed on all sides.

A transport means 12 extends through an inlet port 14 in the bottom wall 4 upwards in the direction of the upper wall 10, runs horizontally along the upper wall, spaced apart from the latter vertically, and then back down in the direction of the bottom wall 4 and through a discharge aperture 16 from the housing. The transport means 12 bears a supporting means, which is not shown in detail in FIGS. 1 to 3, such as a belt, cable, chain or pair of chains, a number of bowls or trays 18. Each tray 18 has a bottom wall 18*a* and a trough-like peripheral side wall 18*b* and is intended to receive a particular quantity of a food product to be packed. The bottom wall 18*a* and/or the side wall 18*b* is/are perforated or consist of a rib mesh or the like, in order to permit the gaseous atmosphere present in the housing 2 to pass through unhindered.

Instead of the trays, a conveyor belt can be provided as the transport means, on which the material to be processed is located, e.g. a flat conveyor belt or one which, seen in cross-section, is concave like a trough, possibly perforated.

The supporting means of the transport means 12 can be guided, via deflection pulleys with a horizontal axis of rotation for example, which may be disposed in the region of deflection points 20, not far from the upper wall 10.

The trays 18 are each conveniently hung on the supporting means on a horizontal pivoting axis 22 running above their centre of gravity, allowing them to swing freely in pendulum fashion, so that they maintain their upright orientation with their bottom walls facing downwards despite the changes in direction of the supporting means.

In the region of a horizontal transfer conveyor 26 running across the direction of movement of the transport means 12, the trays 18 can be tilted about the pivoting axis 22 so that their contents pass via a guide plate 28 onto the upper portion of the transfer conveyor 26. In the process, the trays may be tilted by 120°,150° or 180°. After passing through the region of the transfer conveyor 26, the trays are tilted back to their original alignment. For this purpose, projecting dogs, such as pins or the like, may be provided on the trays, transverse to the direction of transport 13, which co-operate with stationary or movable actuation members or control surfaces in order to tilt the trays.

Figure 2:
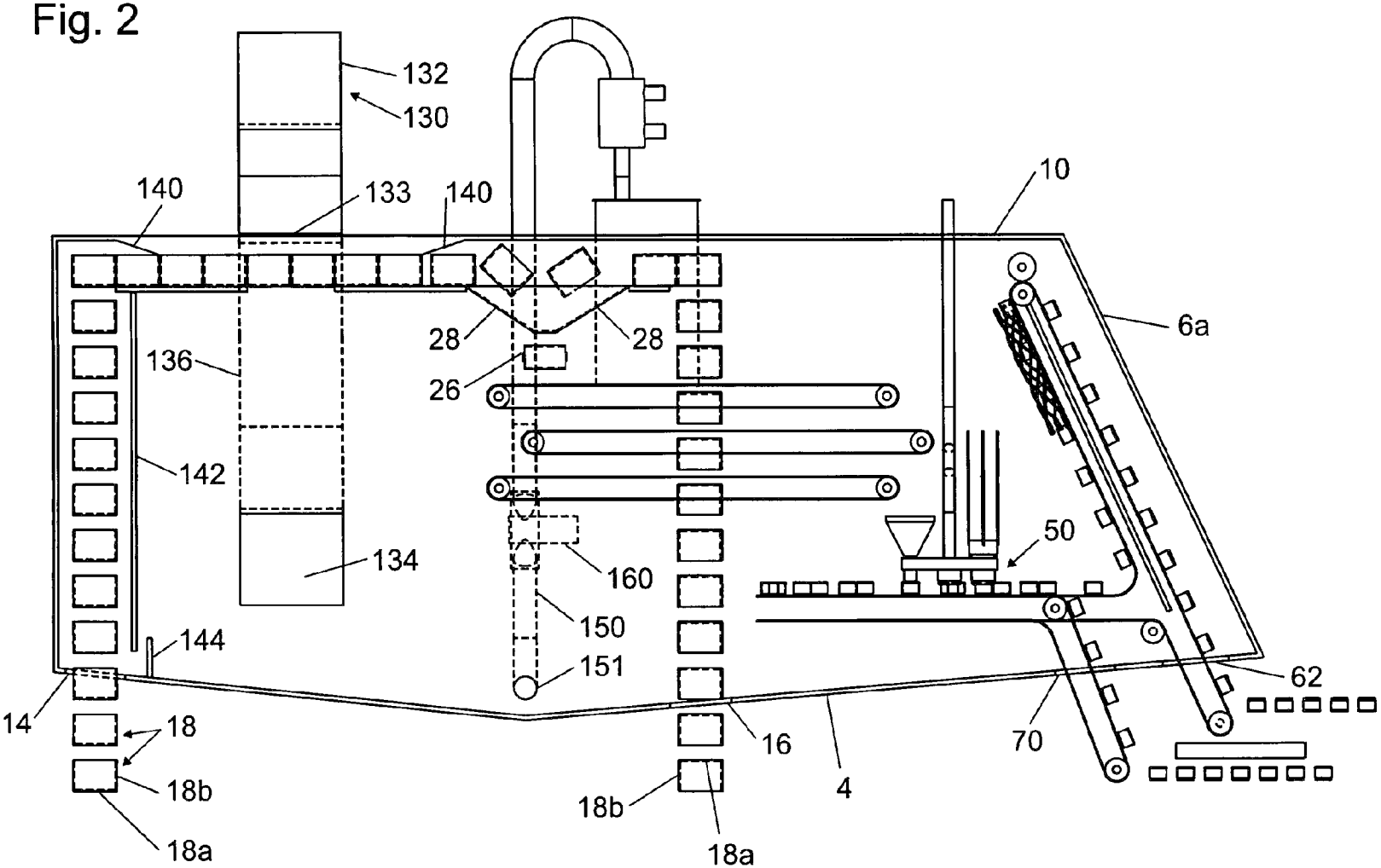
FIG. 2 shows a side view of the apparatus according to FIG. 1.
Figure 4:
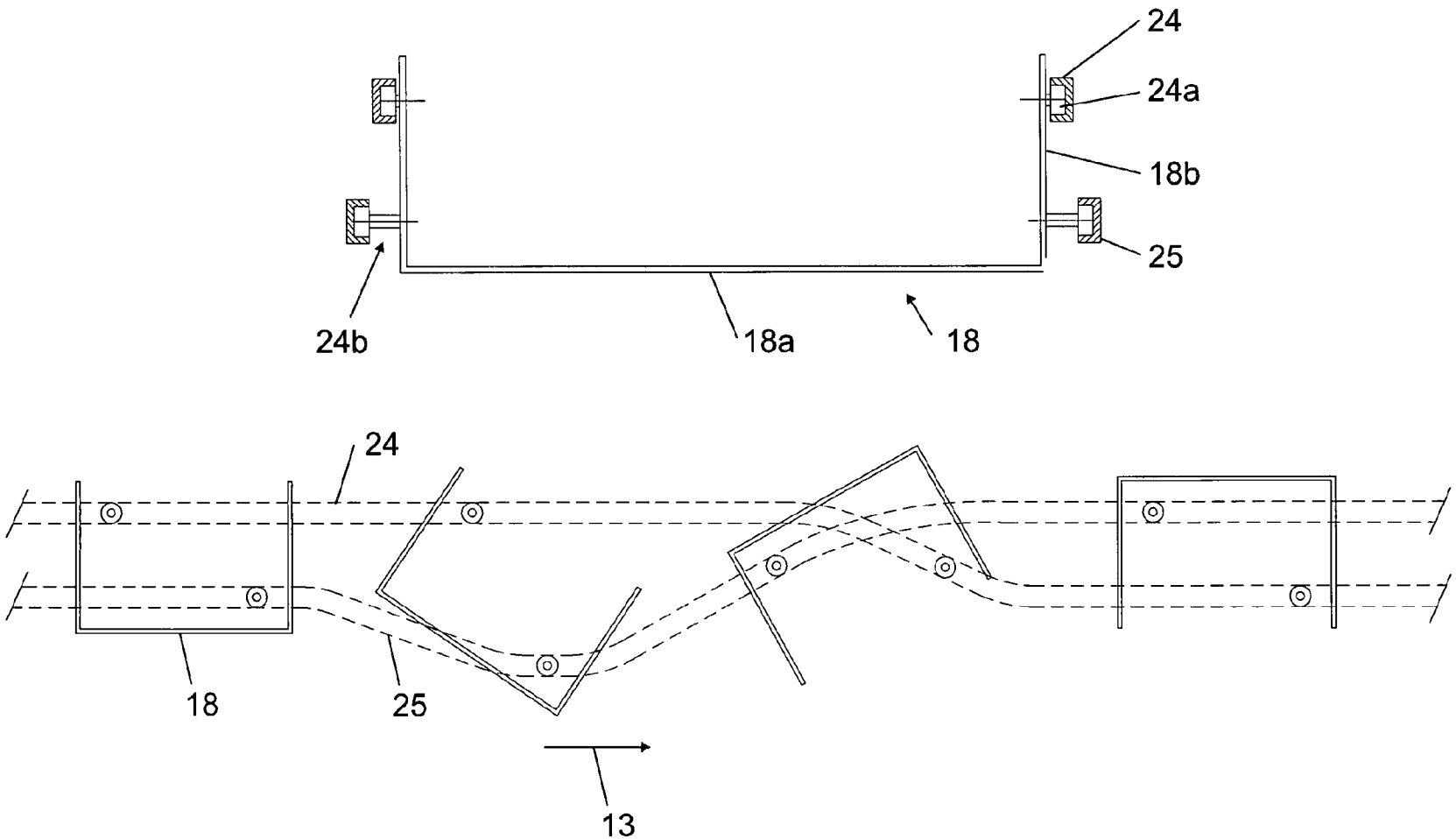
FIG. 4 shows an embodiment of a means of tilting trays.

FIG. 4 illustrates a variant of the transport means 12 for actuating the tilting movement of the trays 18, which also forms the basis for the representation in FIGS. 1 and 2. The supporting means 24, a pair of chains guided in parallel for example, is guided along the path shown and connected to trays 18 at regular distances via pivotable suspensions 24*a*. The trays each have a pair of guide lugs 24*b*, which are guided in guide rails 25. In the region of the transfer conveyor 26, the guide rails 25 are spaced apart differently from the supporting means 24, which results in the tilting or pivoting movement of the trays 18 shown in FIG. 4, so that the material held therein passes to the transfer conveyor 26. The trays are moved out of the discharge aperture in a discharge position (bottom wall up) which is rotated by 180° relative to the delivery position.

A discharge end 30 of the transfer conveyor 26 is located above one end of an arrangement of buffer conveyor belts 34*a*, 34*b*, 34*c*, the respective ends of which are disposed above one another and staggered and are designed for conveying products placed on them by the transfer conveyor 26 in opposite conveyance directions 36, so that a buffering or storage effect results. A discharge end 38 of the lowest buffer conveyor belt 34*c* is disposed above a receiving hopper 40 of a packing apparatus 50 shown by way of example. In the embodiment shown, the packing apparatus 50 has the necessary means for packing food products in screw-topped jars.

For the purpose of packing food products in screw-topped jars, a further transport means 60 is provided, which extends through an entry port 62 in the bottom wall 4 upwards in the direction of the upper wall 8 and is deflected back downwards at a deflection point 64 in the area of the upper wall 8, in order to be deflected into a horizontal direction on a level located between the upper wall and the bottom wall at a deflection point 66. The packing apparatus 50 is disposed in the region of a horizontal section of the transport means 60 adjacent to the deflection point 66 (and after a horizontal deflection 67). After passing the packing apparatus 50, the transport means 60 runs through a further deflection point 68 and leaves the housing downwards through an outlet port 70 in the bottom wall 4.

The transport means 60 has a supporting means 72, which can be designed in the form of a single strand-like, flexible element, which absorbs tensile forces, like a belt, rope or chain, or in the form of two such elements, which are disposed parallel and spaced apart from one another. Holding means for receiving a packing container, in this case a screw-topped jar, are disposed on the supporting means 72 at regular mutual intervals.

Figure 3:
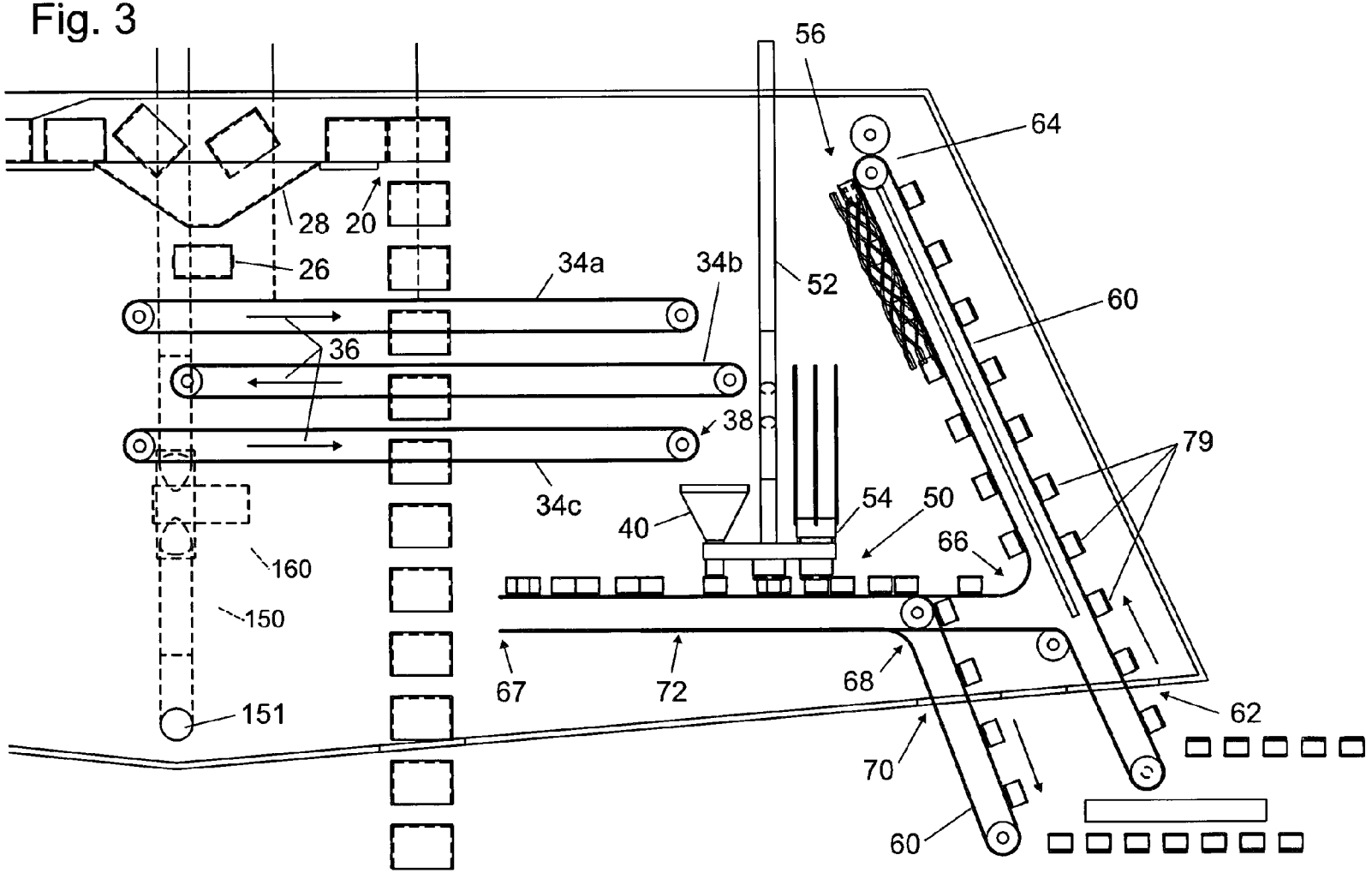
FIG. 3 shows an enlarged detail from FIG. 2.

Whereas FIG. 3 shows an enlarged representation of a section of the transport means 60 in the form of a side view, the supporting means 72 is illustrated in greater detail in FIGS. 13 and 14. In this embodiment, it has two parallel strands of chain 74, to each of which is attached a flexible holding means 76. The two holding means 76 are provided with undulating contours symmetrically to a longitudinal central plane of the transport means 72, and consist of a material with a high coefficient of friction with regard to the packing containers to be held, so that the latter are held securely when the strands of chain 74 are guided at a fixed distance from one another. FIG. 14 shows a plan view of a detail of the supporting means with three packing containers held on it, while FIG. 13 shows a sectional view in the direction of conveyance or transport. FIGS. 12*a* and 12*b* are a schematic side view of a tin 78 and a screw-topped jar 79, of the kind that can be transported by the transport means illustrated in FIGS. 13 and 14. Although they are illustrated in strands of chain 74 as chains or roller chains with chain studs, which run in the same plane as the strands of chain 74, it goes without saying that the strands of chain are flexible in two directions which are perpendicular to one another if necessary.

Figure 15:
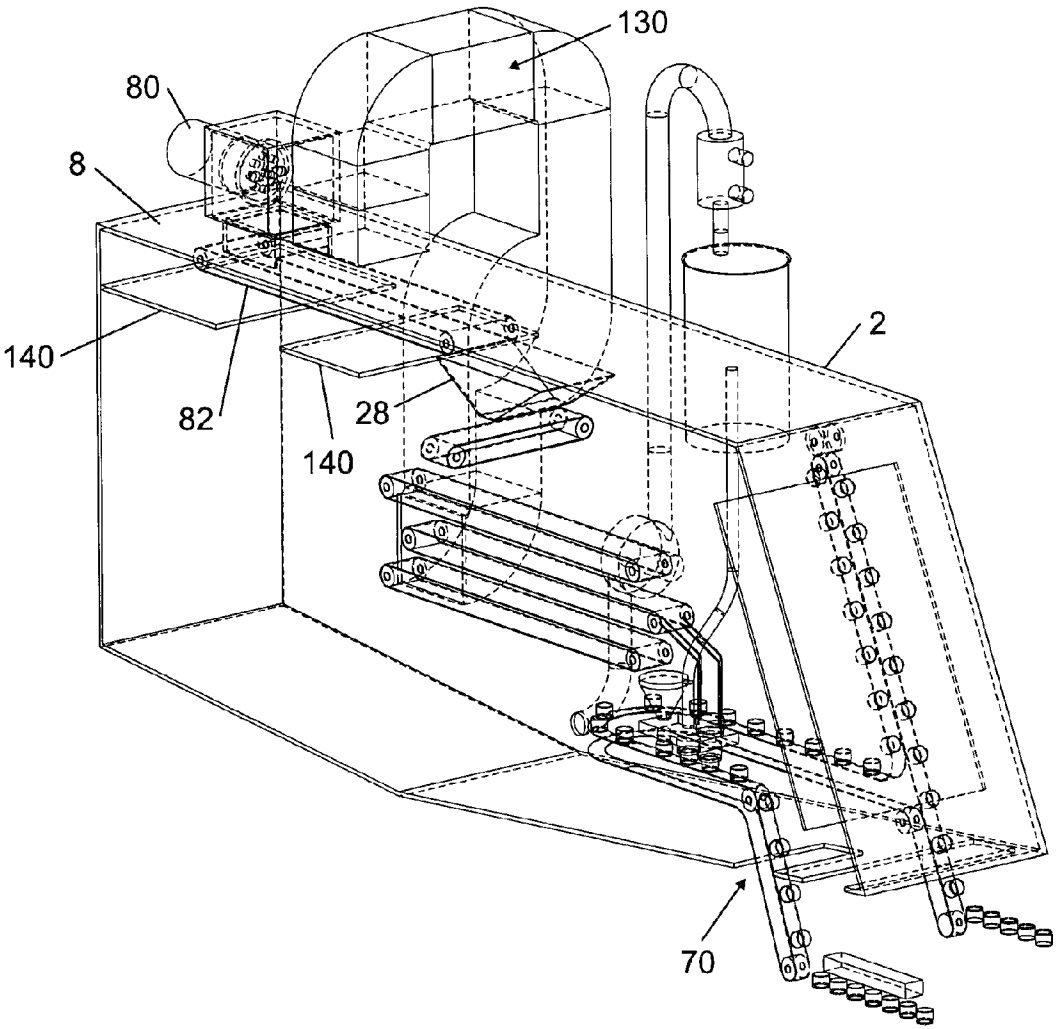
FIG. 15 shows a perspective view of a first variant of the apparatus according to FIGS. 1 and 2, with an extruder.
Figure 16:
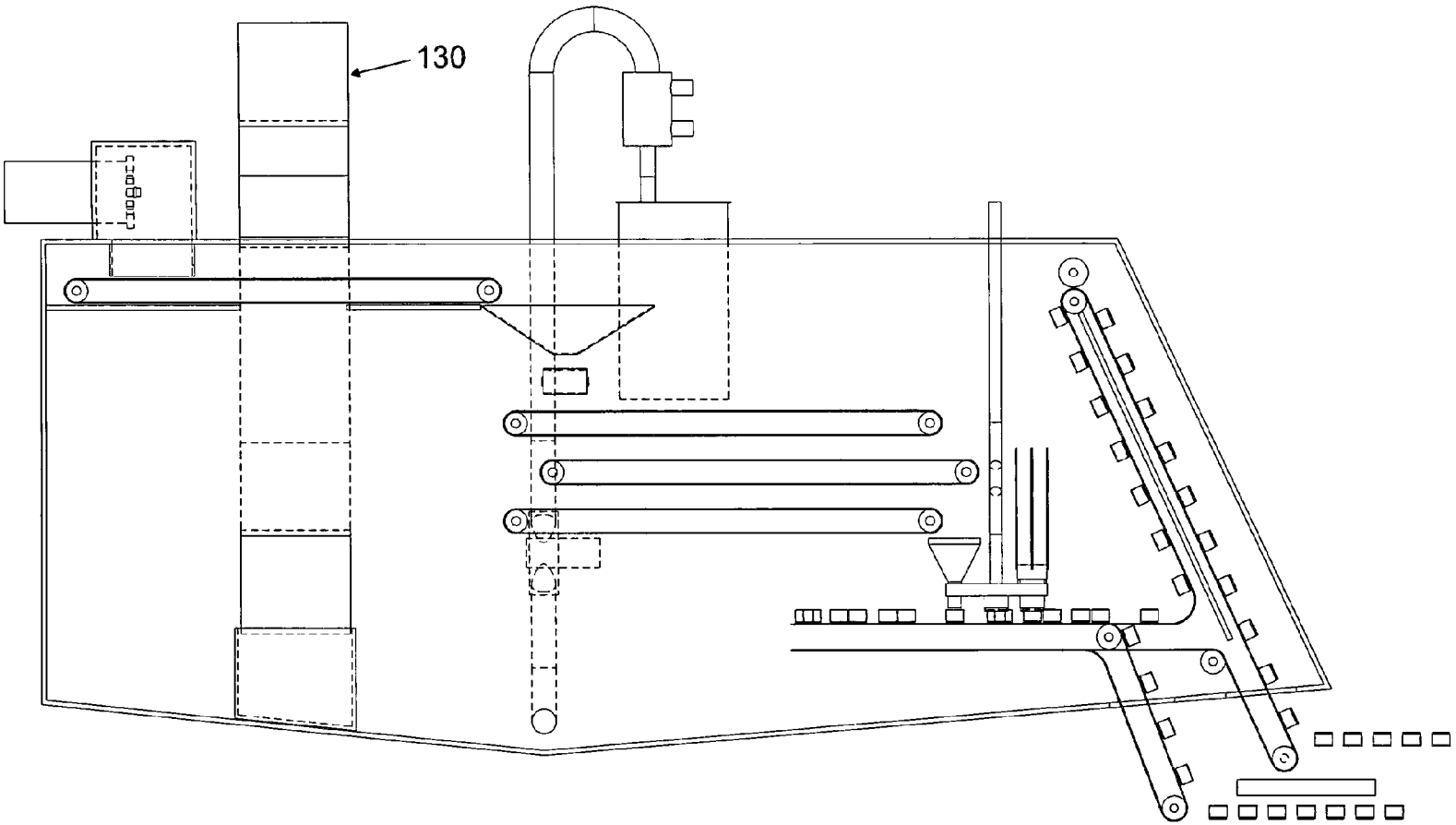
FIG. 16 shows a side view of the apparatus according to FIG. 15.

An alternative possibility of delivering the food product to be packed into the housing is illustrated in FIGS. 15 and 16. As the first transport means in this case for transporting the food product into the housing, an extruder 80 is provided, which in this case is designed as a so-called boiler-extruder, i.e. in which and/or at the outlet from which where the product enters the housing a temperature of 100° C. is reached or exceeded, so that the extruded product already possesses a considerably reduced germ count. The extruder 80 leads into the housing 2 near the upper wall 8 and works onto an intermediate conveyor 82, which transfers the extruded material via a guide plate 28 onto the buffer conveyor belts 34*a, b, c*, which have already been described, from where, as previously described, it reaches the packing apparatus 50.

This embodiment offers the advantage that it is possible to work in an unbroken sterile or low-germ manner, since the product no longer comes into contact with ambient air after extrusion, as becomes clear from the following description of the gaseous atmosphere.

In the embodiment shown here, the packing apparatus 50 has three stations, namely a receiving station, formed here by the receiving hopper 40, then an addition station, formed here by an addition line 52, which is directed outwards from the housing, and with which one or more additives, e.g. flavor enhancing substances or probiotic additives, can be added to a product introduced into a respective packing container at the receiving station, and then also a sealing station with a sealing apparatus 54, with which the respective packing container is sealed, in this example by means of a screw cap in each case.

The screw cap or the lid to be placed on the open tin and knurled shut may have a transparent portion in the form of a window, so that the surface of the product inside the packing container is visible from the outside. The transparent portion can extend over the greater part of the lid, apart from an edge portion of metal or plastic which is necessary for screwing on or knurling.

As a further variant instead of a screw cap, a sealing lid can be provided in the case of a jar or tin which is not kept in place by a positive lock (screw thread or knurling), but rather solely by the atmospheric over-pressure relative to the partial vacuum inside the finished packing container. For this purpose, the lid can be provided along its outer circumference with a resilient sealing material which, after the lid is placed on top, co-operates with an upper edge of the packing container in a sealing fashion and seals the lid under the effect of the atmospheric pressure.

As is already suggested by FIGS. 1 to 3, the screw-topped jars 79 are introduced into the housing in a position in which they are open at the bottom, i.e. with their floors, shown thicker, facing upwards. As a result, the ambient air contained in the jars is given the possibility of flowing out, since the steam atmosphere is lighter in terms of its specific gravity, so that the screw-topped jars are filled with steam in the desired manner. In order to be able to continue this process as far as the deflection point 66, and so that the jars have their open ends facing upwards in the region of the packing apparatus 50, where they are filled, they are rotated by 180° in the region of the deflection point 64. FIGS. 3*a* and 3*b* illustrate this schematically. Before or after or even in the region of the deflection point 64, there is a twist 56, illustrated by way of example by four wire guides 58, which are bent in a helical manner and each of which extends over 180°. An empty packing container delivered at one end of the twist, the floor of which is shown schematically thicker and which is at the bottom, is guided loosely by the wire guides 57 as it runs through the twist and is rotated by 180° in the process, so that the position illustrated results at the other end of the twist (see also FIGS. 2*a* and 17).

The transfer of the packing containers—from the parallel strands of chain 74 (FIGS. 13, 14), for example—to the twist and vice versa might be effected in that, when entering the twist, the strands of chain 74 are guided apart and then guided back together again at the end of the twist, in order to release the packing containers and receive them again. Alternatively, after entering the twist, the strands of chain 74 can be lowered and then raised again in the region of the end of the twist, in order to release the packing containers and receive them again.

Although two transport means are provided in the examples shown, which are constructed separately from one another and work independently of one another, namely the transport means 12 and the further transport means 60, it could be contemplated to replace them by a single transport means which runs past a packing apparatus. The packing containers needed could then either be taken from a store present inside the housing, which would have to be filled at certain intervals, or would have to be supplied from outside by means of a feeder means.

As an alternative to packing in tins or screw-topped jars, the further transport means 60 can be designed, as FIGS. 5 to 11 show, for transporting pouches 86, which consist, in a manner known per se, of two rectangular sections of film 88, which are sealed together on two or three sides, so that one filling edge 90 of the pouch is still open. The pouches 86 are held on both sides by a pair of grippers 92, which for their part are attached to gripper chains 94. After being filled with the food product, the pouches are sealed with a sealing apparatus disposed inside the housing 2 along the filling edge 90 by thermoplastically welding the two sections of film using a heated sealing rod or by ultrasound.

Figure 5:
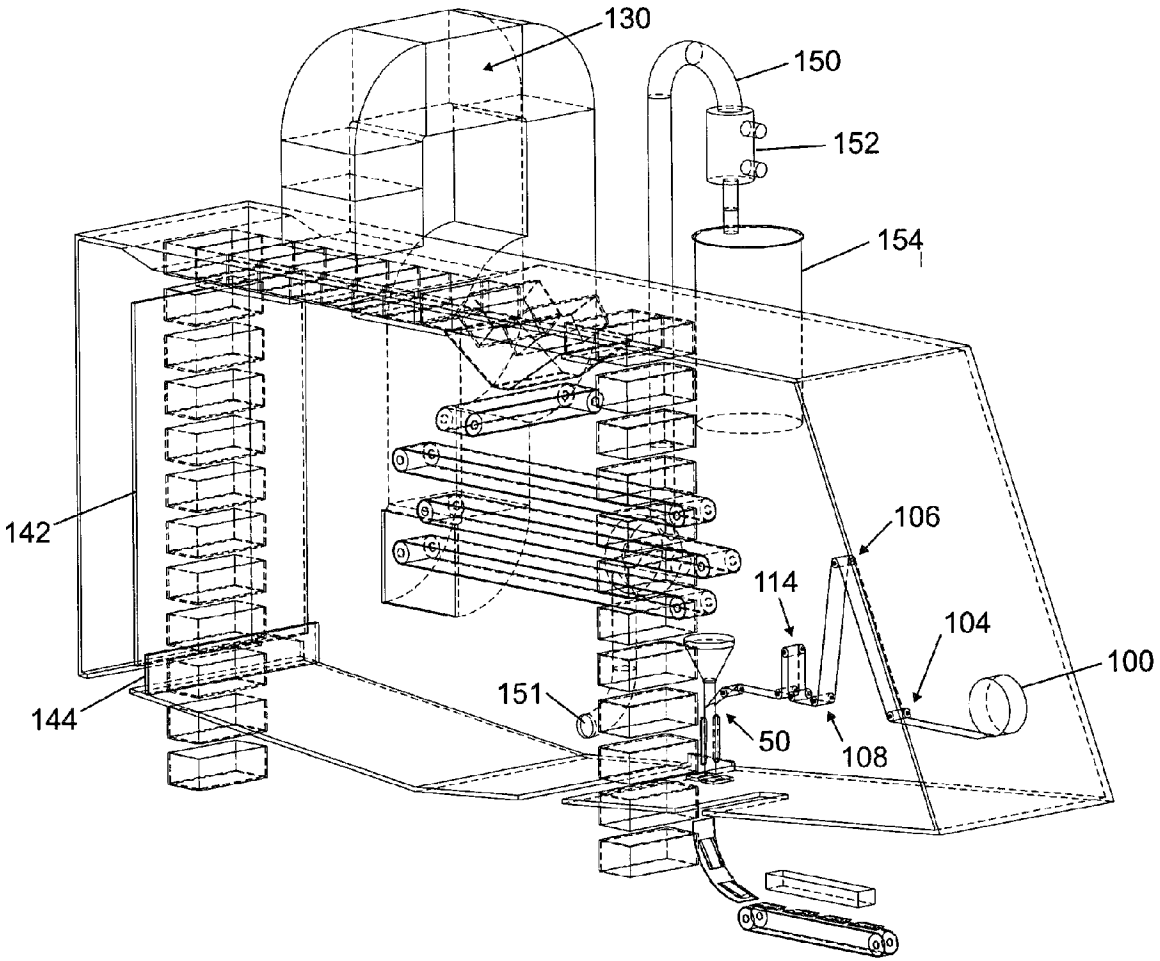
FIG. 5 shows a perspective view of a first enlarged detail from FIG. 2.
Figure 6:
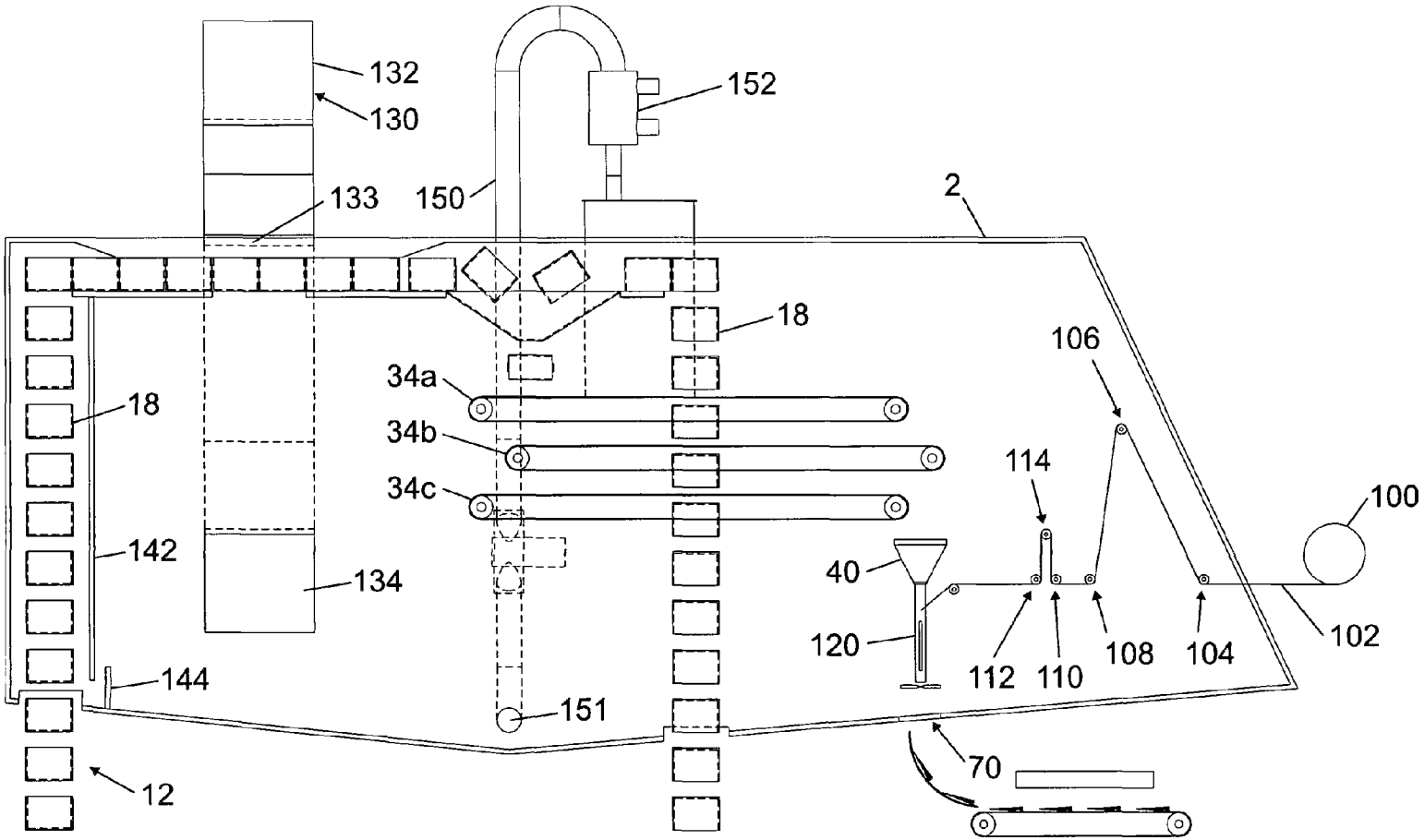
FIG. 6 shows a side view of the apparatus according to FIG. 5.
Figure 7:
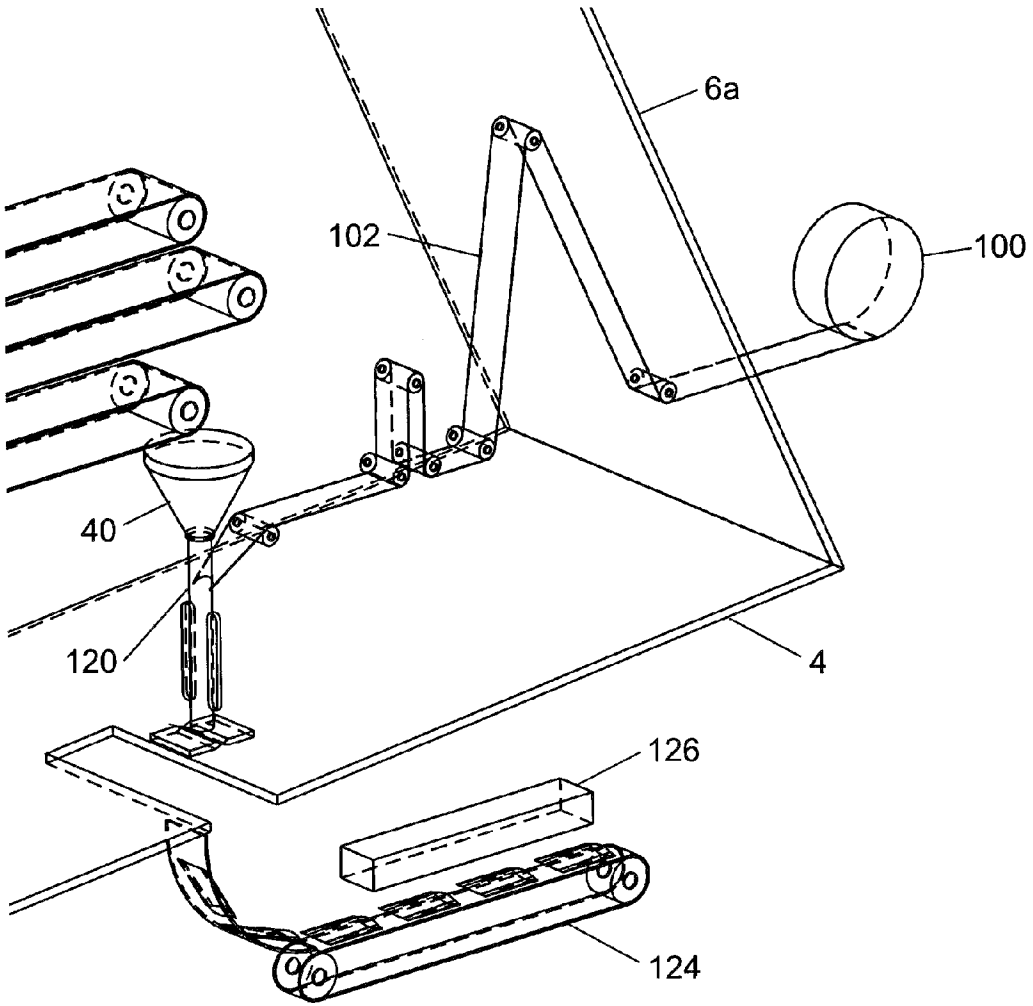
FIG. 7 shows a detail from FIG. 5.
Figure 11:
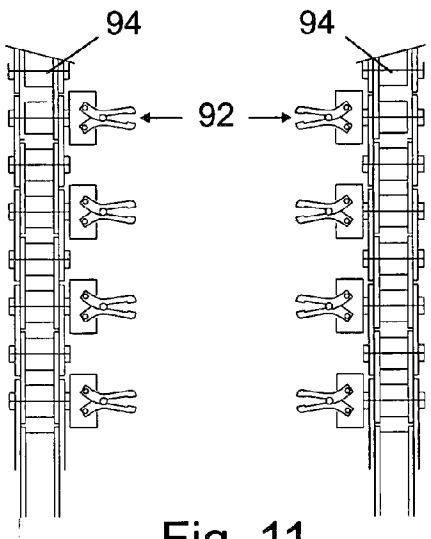
FIG. 11 shows a plan view of a section of the transport means without pouches.
Figure 9:
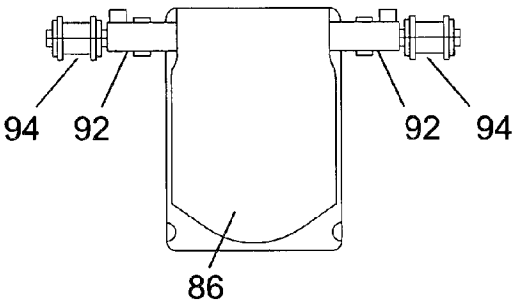
FIG. 9 shows a view of a transport means for pouches in the direction of transport.
Figure 10:
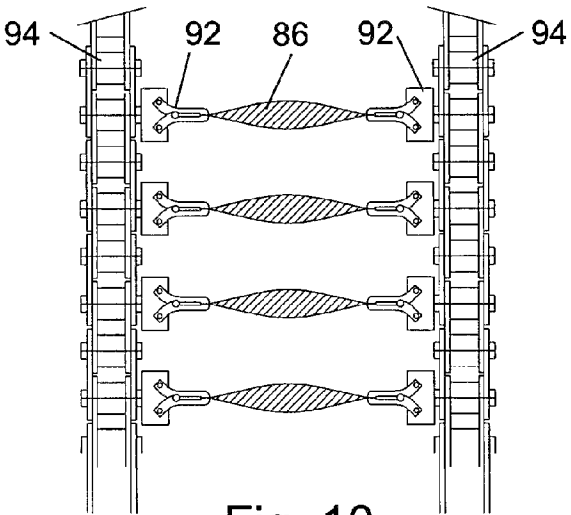
FIG. 10 shows a plan view of a section of the transport means with pouches held on it.
Figure 8:
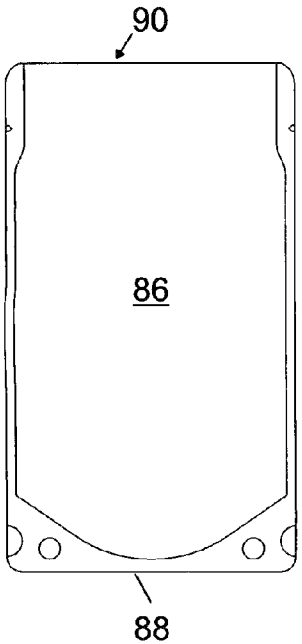
FIG. 8 shows a schematic plan view of a pouch pack as an example of a packing container.

As FIGS. 5 to 7 show, the pouches serving as packing containers can be produced, filled and sealed directly inside the housing 2 with a forming, filling and sealing apparatus which is known per se. By way of explanation of this approach, which is known per se, FIG. 7 shows first of all, in an enlarged detail, a roll of film 100 disposed outside the housing 2, from which web-like film material 102 is drawn.

The film material 102 is guided via deflection rollers 104, 106 and 108 in the direction of the upper wall 8 of the housing 2 and then runs through two fixed deflection rollers 110, 112 and a compensating roller 114 arranged between them, which is movable in a vertical direction and which serves to ensure that the film material 102 runs smoothly.

After passing across a further deflection roller 116, the film material 102 is brought to rest against a cylindrical outer surface of a charging tube 120, which is provided at an upper end with a receiving hopper 40. Means, which are not shown in detail, for welding the film material in the machine direction and cross-machine direction serve to produce individual film bags which, after filling and sealing, pass through the outlet port 70 onto a removal conveyor means 124, in the course of which the cooling of the filled pouches by means of a cooling apparatus 126 can be accelerated.

In order to generate a desired gaseous atmosphere with superheated steam inside the housing 2, such as is described in U.S. Pat. No. 5,711,086, there is a heating apparatus 130 (FIGS. 1, 2, 5, 6, 15, 16), which can take the form of an electric heating element or heat exchanger and is disposed inside a conduit 132, via which it is coupled to the housing 2. The conduit leads, on the one hand, into an aperture 133 in the upper wall 8 and, on the other hand, into an aperture 134 in the rear wall 10. In order to generate a flow through the heat exchanger 130 a fan 136 is disposed in the conduit 132, with which a flow can be generated in the direction of flow 138. Although the aperture 134 is illustrated at a relatively low position inside the housing 2, i.e. in the vicinity of the bottom wall 4, it can be disposed higher up, such as in the region of the upper wall 8, immediately below the transport means 12, and possibly, when seen in the direction of transport 13, staggered by a certain distance relative to the aperture 133 in the upper wall 8, into which the conduit 132 leads, in order to avoid a short-circuit effect. The housing 2 can be provided with inlet and outlet ducts, through which the transport means extend, and a vent line, as explained in FIG. 2*a*.

In order to accelerate or intensify the generation of the desired gaseous atmosphere, a steam feed line, not shown, can be used to introduce superheated steam directly into the housing 2. Alternatively, it can be provided that a steam or water feed line, such as a water atomizer, leads into the conduit 132 upstream of the heating apparatus 130, so that by heating the steam or evaporating the water, a superheated steam atmosphere can be introduced in the region of the aperture 134.

Beneath the aperture 132, baffle plates 140 facing each other are attached to the upper wall 8 as flow guides or sealing means, which are intended to ensure that the steam atmosphere extracted from the housing 2 through the aperture 133 first flows to the greatest possible extent through the perforated tray or trays 18, which are located just below the aperture 133. This ensures that the product located in the trays comes into intimate contact with the superheated steam. In the embodiment according to FIGS. 15, 16, two horizontal baffle plates 140 are provided, it being possible for the intermediate conveyor 82 to have a perforated carrying belt, in order to enable steam to pass through in the best possible manner.

Two further baffle plates 142, 144 (FIGS. 1, 2, 5, 6) are arranged substantially parallel to the left-hand side wall 6*b* and overlapping with a slight space between them. The task of these baffle plates is, as far as possible, to prevent excessive amounts of ambient air being introduced into the housing 2 by the moving transport means 12. A gap between the baffle plates in the vicinity of the bottom wall 4 allows air or an air-rich steam atmosphere of relatively high density to escape.

A further guide plate 146 serves to remove ambient air or steam with a large proportion of ambient air through the aperture 62, since it is unavoidable that a certain amount of air enters the housing together with the containers 79.

Alternatively or in addition, a nozzle-like flow guide for the steam can be provided by means of a narrowing, in order to cause a local increase in the flow speed and thus improved contact with the product.

Since an uncontrolled exit of the steam atmosphere from the housing 2 is undesirable, an extraction line 150 is provided, which leads into an extraction port 151 in the rear wall 8 immediately above the bottom wall 4 and leads to a condenser 152, from where the water condensed out is directed into a container 154. Extraction is effected by a controlled fan 160, which is controlled by information on the temperature and humidity or steam content. For this purpose, temperature and steam content sensors are arranged in the housing, preferably one temperature sensor and one moisture or steam content sensor in the vicinity of the upper wall 10 and near the bottom wall 4 or near the extraction port 151. The extraction port 151 can be provided in the bottom wall 4 or at any height above that. The lower it is located, the lower is the temperature of the steam extracted.

Figure 2A:
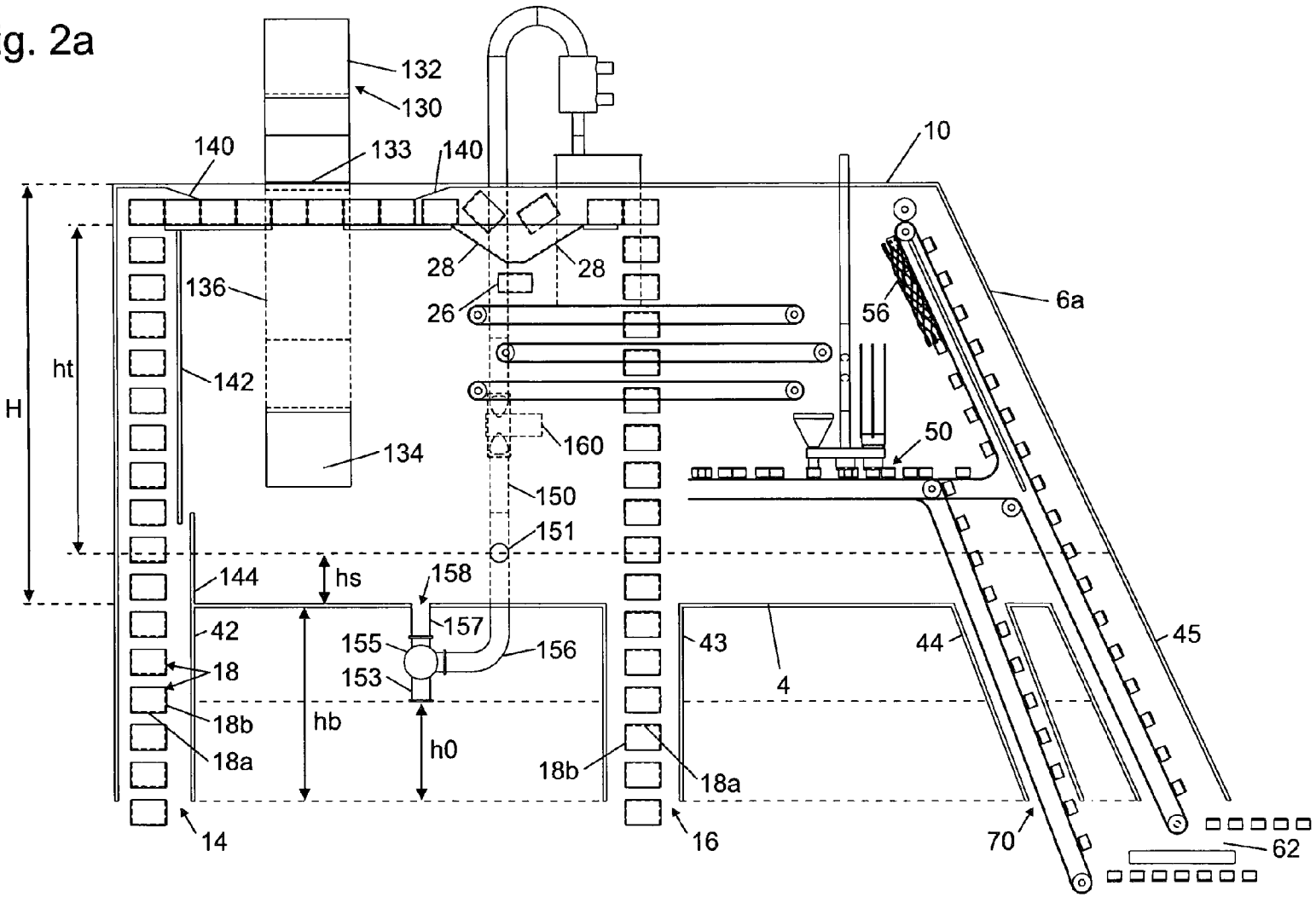
FIG. 2*a* shows a side view of the apparatus according to FIG. 1 in a variant.
Figure 3A:
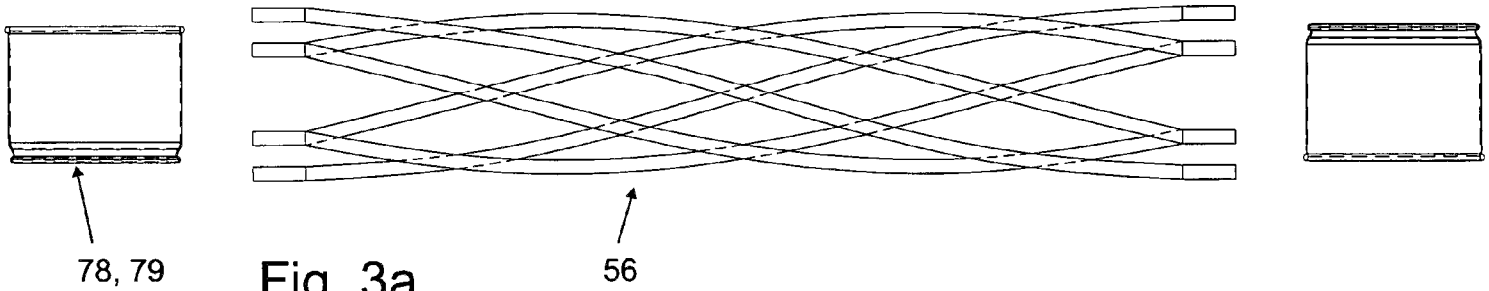
FIGS. 3*a, b* show a detail from FIGS. 1 to 3.
Figure 3B:
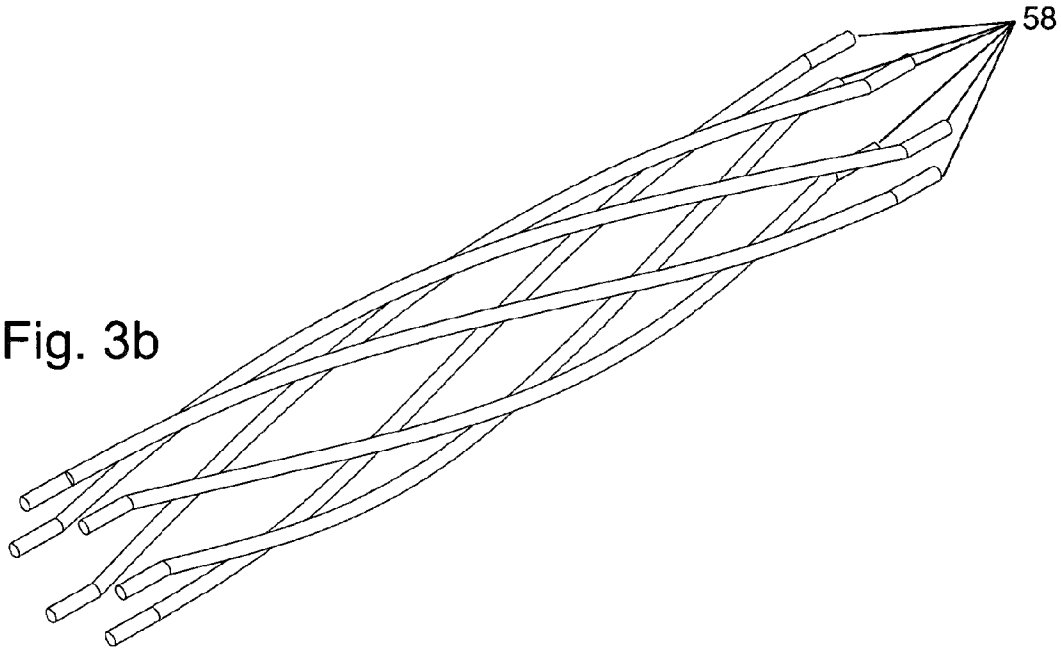

FIG. 2*a* illustrates a variant of the apparatus according to FIGS. 1 and 2, in which first of all saturated steam and thus surplus moisture can be guided out of the housing via a vent line 153 as an alternative to extraction via the extraction port 151, or both. The vent line 153 communicates with a three-way valve 155, which further communicates via a conduit 156 with the extraction line 150 and with a further conduit 157 with a port 158 in the bottom wall 4. The vent line 153 has a venting aperture 159 leading to the surroundings.

The three-way valve 155 can be placed in a first position, in which the lines 156 and 157 communicate, while the line 153 is sealed off, so that extraction takes place via the ports 151 and 158. If desired, a check valve may be provided in the line 156 in order to be able to ensure that in the first position of the three-way valve, extraction occurs exclusively via the port 151.

The three-way valve 155 can be placed in a second position, in which the vent line 153 communicates with the conduit 157, while the conduit 156 is sealed off and the fan 160 is switched off, so that the steam atmosphere within the housing communicates with the surroundings via the port 158 and the conduits 157 and 153.

Unlike the apparatus according to FIGS. 1 and 2, the apparatus illustrated in FIG. 2*a* has a number of guide channels 42, 43, 44 and 45, which extend the housing downwards in the region of the holes in the bottom wall, namely the inlet port 14, the discharge aperture 16, the entry port 62 and the outlet port 70, and terminate openly at substantially the same height. The guide channels surround the transport means 12 and 60 at the inlet and outlet ends and, together with the vent line 153, which terminates at a higher level, cause surplus steam to be discharged from the interior of the housing 2 via the vent line 153, in the second position of the three-way valve 155. The steam present inside the housing has a tendency to flow downwards through the guide channels, but in the process it encounters relatively cold ambient air, so that a substantially horizontal boundary layer forms in all the guide channels at the height of the venting aperture 159. The height h0 at which the venting aperture 159 is located above the height of the free end of the guide channels may, for example, 10%, 20%, 30% or 50% of the height H of the housing, H referring to the vertical distance between the highest and lowest point of the interior of the housing. In addition, the height h0 is preferably between about 30% and 70%, e.g. 50%, of the vertical extent hb of the guide channels, beginning at the lower wall 4 or the lowest point of the housing.

In all embodiments, a height hs of the extraction port 151 above the lower wall 4 of the housing or the lowest point of the housing may be virtually zero in effect, or it may be about 5%, 10%, 15%, 20% or 30% of H. A height ht at which the actual drying process mainly takes place and at which or above which the horizontal sub-layer is preferably located, in which the gaseous atmosphere is of the desired high temperature and exhibits low oxygen values, may be about 50%, 60%, 70%, 80%, 90% or 95% of the height H of the housing, measured in each case from the lower wall of the housing 4 or the lowest point of the housing.

Figure 17:
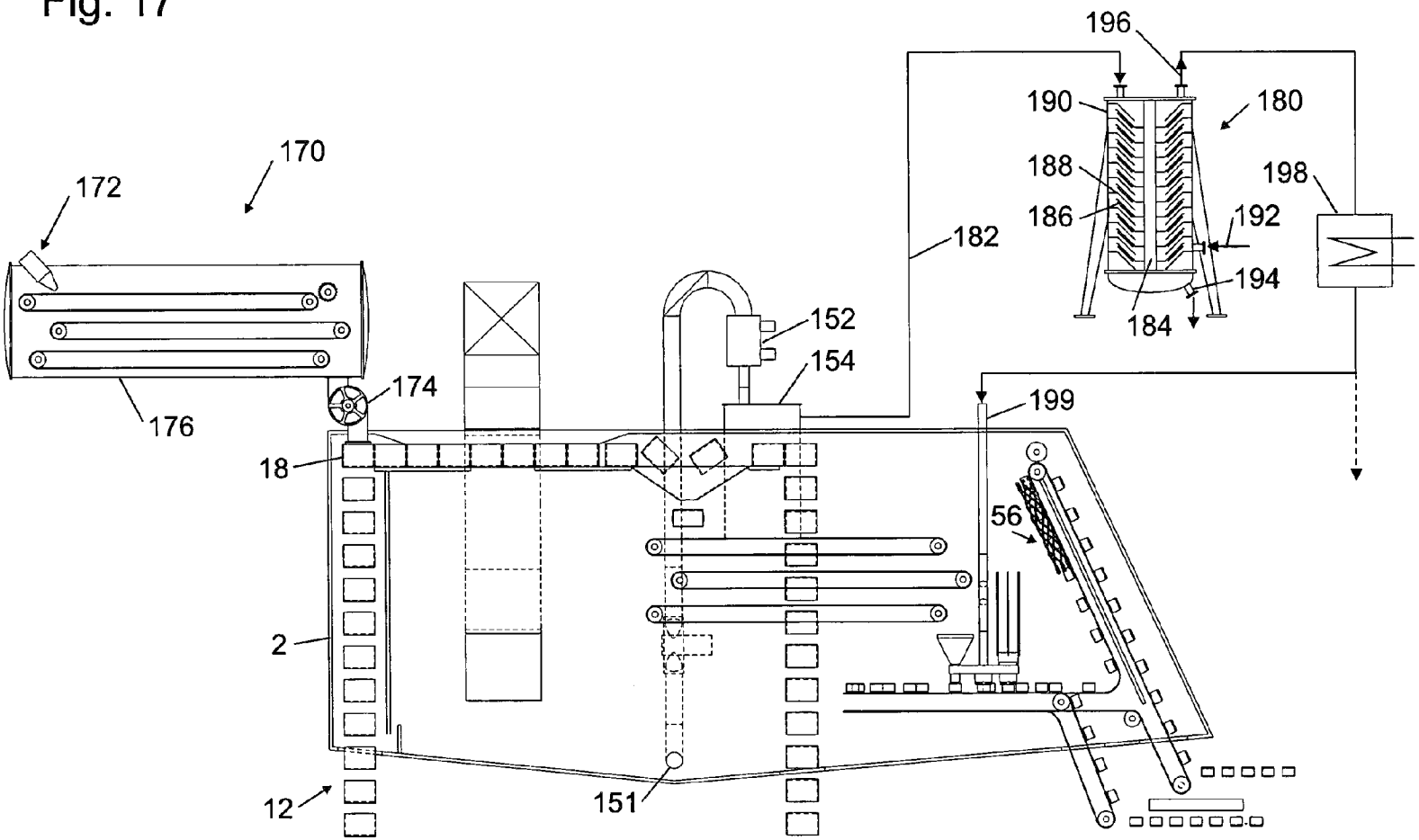
FIG. 17 shows a side view of a second variant of the apparatus according to FIGS. 1 and 2, with a delivery station with a lock.

FIG. 17 shows a side view of a second variant of the apparatus according to FIGS. 1 and 2, where the product to be treated, similar to the first variant, is not transported into the housing via the first transport means 12, but is rather conveyed via a delivery means 170, which is connected to the housing, and a lock, in this case a cellular wheel sluice 172, directly in the upper part of the housing 2 and thus in the region of the hottest superheated steam onto the first transport means 12, in this case into individual trays 18 of the first transport means, the further process being as in FIGS. 1 and 2.

The delivery means 170 has a pressure reservoir 176 which can be filled by a lock 174 and into which steam can be admitted for sterilization purposes. The sterilization time is dependent on the temperature of the steam and the F0 value required, i.e. the desired sterilization quality. After the desired F0 value has been reached, the pressure reservoir is depressurized via a valve, and the product is conveyed via the lock 172 directly into the housing 2.

The delivery means 170 is particularly suitable for delivering pieces of product produced by machine, which may, for example, contain meat, artificial meat, cereals etc. Thanks to the manufacturing process without extrusion, it is possible to preserve a coagulated protein structure in the pieces of product.

The temperature of, for example, 120° C. to 180° C. prevailing in the housing 2, at least in a horizontal sub-layer accounting for part of the height H, prevents renewed contamination with micro-organisms before the packing containers are sealed.

The steam in the pressure reservoir 176 required for sterilization can be removed from the housing 2 and raised to a higher energy level by means of a compressor.

FIG. 17 also shows an extraction unit 180 for volatile substances, such as flavors, contained in the condensate which accumulates in the condenser 152 and is collected in the container 154.

Since it would be very difficult to extract the volatile substances contained in the steam extracted through the extraction port 151 directly from the steam phase, this is done in a manner known per se by means of a rotating-table column or rotating-cone column, also referred to as a spinning cone column, SCC, which is the most important element of the extraction unit 180.

The condensate containing the substances to be extracted is delivered to the unit 180 via delivery line 182, which bears a number of rotating, cone-shaped plates 186 mounted on a rotating shaft 184. Between each two rotating plates there is a fixed, likewise cone-shaped plate 188, which is connected in each case to the outer, closed housing 190 of the apparatus.

In addition to the product to be treated, steam and/or inert gas 192 are supplied to the extraction unit in the opposite direction to the product. Escaping steam with volatile substances which have not been deposited or extracted is indicated by 194.

Extracted substances can be removed at the bottom of the unit at a product outlet 196.

The volatile substances extracted, such as flavors, can either be added to the product to be packed, as indicated by 199, such as in the form of a gravy, or may be put to some other use. This kind of extraction can be used advantageously with any embodiment of the invention.

Figure 18:
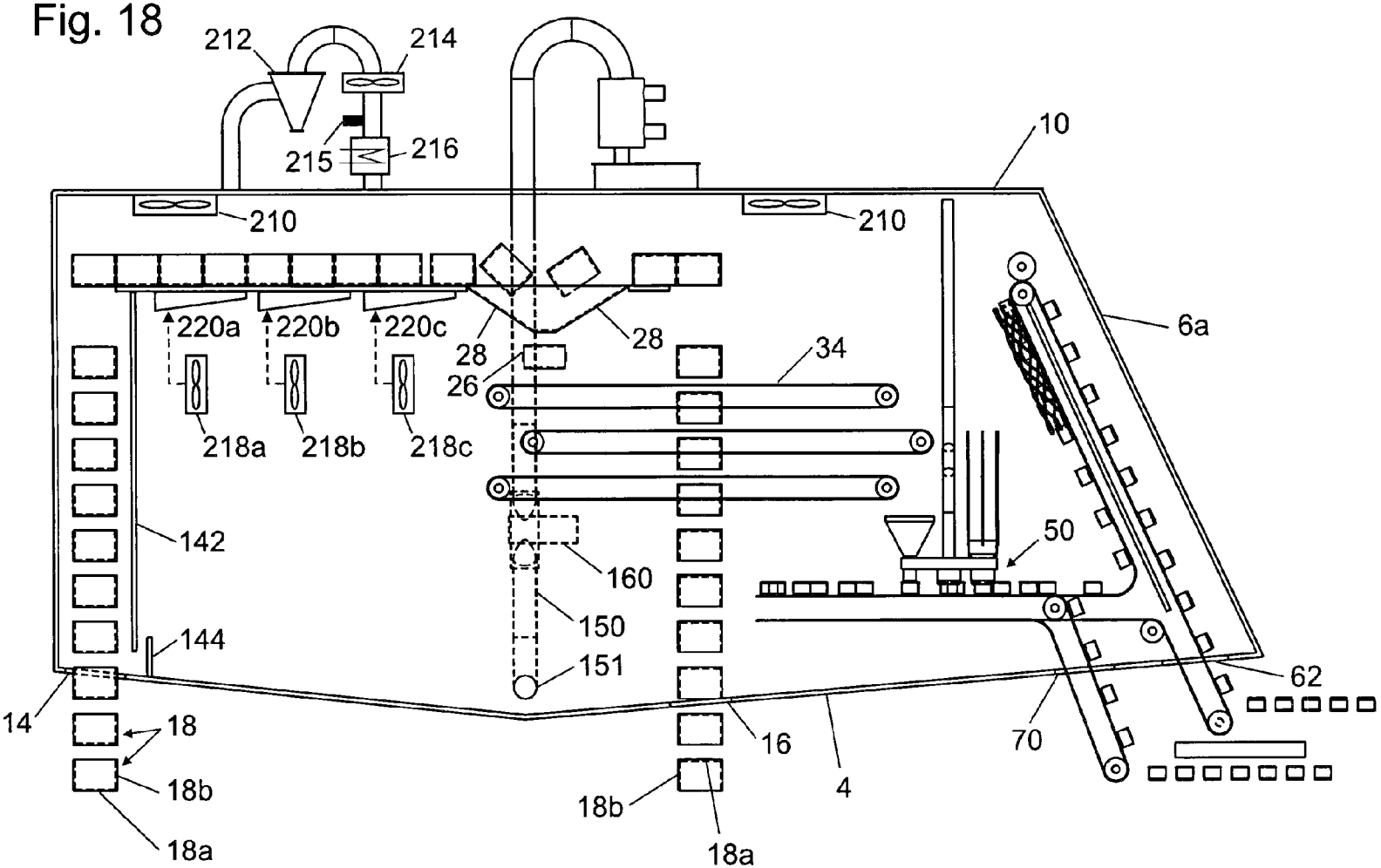
FIG. 18 illustrates a variant of the invention.
Figure 19:
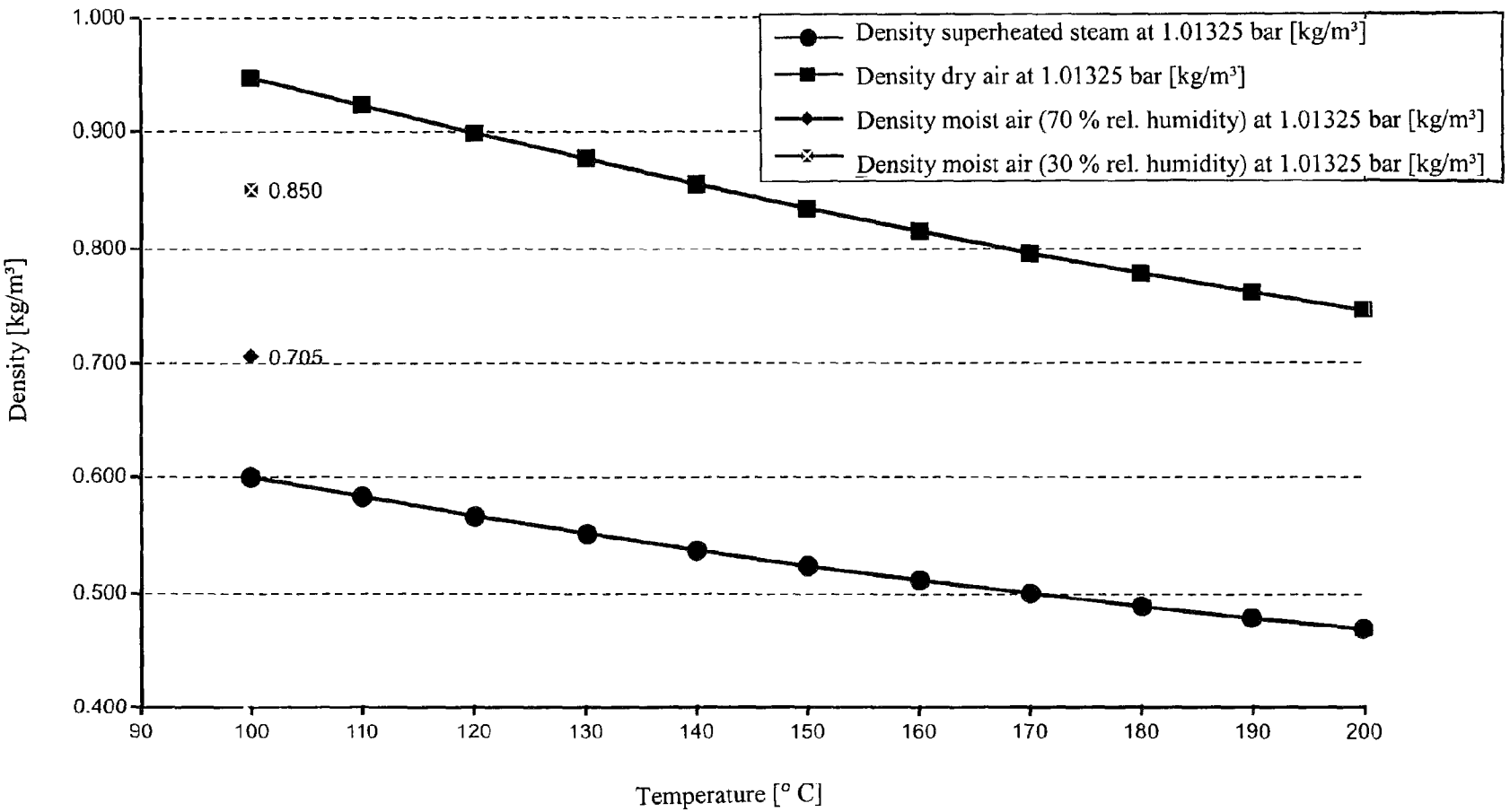
FIG. 19 shows density values of superheated steam, dry air and moist air for different relative humidity values (rh).

FIG. 18 illustrates a modification of the invention which can be used in all the embodiments described above, and in which—unlike the embodiments illustrated in FIGS. 1 to 3—the aim 1s not to have a distinct horizontal succession of layers with a steam atmosphere that, moving from bottom to top, becomes warmer, poorer in air and oxygen and increasingly containing only superheated steam, but rather a steam atmosphere which is mixed as thoroughly as possible and homogenized within the entire housing. This is achieved in that the interior of the housing is evenly mixed with the aid of at least one circulation fan 210 (FIG. 18 shows two of them), so that virtually no stratification or uneven mixing can become established in the vertical direction.

In addition, the contact between the material to be dried and the steam atmosphere is improved with a forced circulation system consisting of a cyclone 212, a fan 214, a heat exchanger 216, fans 218*a, b, c* and, connected to them, steam guide boxes 220 a, b, c. Depending on what is more appropriate, the cyclone 212, fan 214, heat exchanger 216 and fans 218*a, b, c* may be disposed inside or outside the housing 2. Depending on the flow conditions, either the fan 214 or the fans 218*a, b, c* may be dispensed with. The fan 214 sucks in the steam atmosphere across the cyclone 212 upstream, in which particles originating from the material to be dried are deposited. The cyclone for its part sucks in the steam atmosphere at any suitable point or area within the housing. After the fan 214, the steam atmosphere flows through the heat exchanger 216, having optionally been enriched with steam beforehand by means of a steam generator 215. In the heat exchanger 216, heat may be supplied or removed as required, whereupon the steam atmosphere then enters the steam guide boxes 220*a, b, c* via the fans 218*a, b, c*. The steam guide boxes guide the steam atmosphere through a preferably perforated conveyor belt of the transport means 30, so that the material on it is brought into intimate contact with the steam atmosphere.

Since different techniques for introducing the material to be dried into the housing are described in FIGS. 1 to 3, 15 and 17 (transport means with trays, extruder und delivery station with a lock), the delivery of the material to be dried and packed is merely indicated in FIG. 18. In the variants described in FIGS. 15 und 17, the steam guide boxes 220 could be used in the form illustrated in FIG. 18, whereas in the embodiment according to FIG. 1, an adaptation to the transport means with trays is possible, for example in the manner of the flow guide or sealing means 140 (guide plates), or they could be used in connection with the transfer conveyor 26 or the buffer conveyor belts 34.

List of Reference Numerals

1 Apparatus
2 Housing
4 Bottom wall
4*a, b* Bottom wall part
6*a, b* Right-hand, left-hand side wall
8 Rear wall
10 Upper wall
12 Transport means

13 Direction of transport
14 Inlet port
16 Discharge aperture
18 Tray
18*a* Bottom wall
18*b* Side wall
20 Deflection point
22 Pivoting axis
24 Supporting means
24*a* Suspension
24*b* Guide lugs
25 Guide rail
26 Transfer conveyor
28 Guide plate
30 Discharge end (of 26)
34*a, b, c* Buffer conveyor belt
38 Discharge end
40 Receiving hopper
42-45 Guide channel
50 Packaging apparatus
52 Addition line
54 Sealing apparatus
56 Twist
58 Wire guide
60 Transport means
62 Entry port
64,66 Deflection point
67 Horizontal deflection
68 Deflection point
70 Outlet port
72 Supporting means
74 Strand of chain
76 Holding means
78 Tin
79 Screw-topped jar
80 Extruder
82 Intermediate conveyor
86 Pouches
88 Section of film
90 Filling edge
92 Gripper
94 Gripper chain
100 Roll of film
102 Film material
104, 106, Deflection roller
108
110, 112 Deflection roller
114 Compensating roller
116 Deflection roller
120 Charging tube
124 Removal conveyor means
126 Cooling apparatus
130 Heating apparatus
132 Conduit
133, 134 Aperture
136 Fan
138 Direction of flow
140 Guide plate
142, 144 Guide plate
146 Guide plate
150 Extraction line
151 Extraction port
152 Condenser
153 Vent line
154 Container
155 Three-way valve
156 Conduit
157 Conduit
158 Port
159 Venting aperture
160 Fan
170 Delivery means
172, 174 Lock
176 Pressure reservoir
180 Extraction unit
182 Delivery line
184 Shaft
186 Rotating plate
188 Fixed plate
190 Housing
192 Steam inlet
194 Steam outlet
196 Product outlet
198 Feed line for extracted substances
210 Circulation fan
212 Cyclone
214 Fan
215 Steam generator
216 Heat exchanger
218*a, b, c* Fan
220*a, b, c* Steam guide box

The invention claimed is:

1. A method for packing a material in a packing container, comprising the steps of:

providing a gaseous atmosphere with superheated steam in a single housing surrounding an interior space which is enclosed on all sides, supplying a material to the gaseous atmosphere, delivering a packing container having an open end to the gaseous atmosphere in which the packing container is positioned such that the open end is facing downward to allow ambient air to flow out and gaseous atmosphere to flow in, rotating the packing container by 180°, filling the material into the packing container, sealing the packing container inside the gaseous atmosphere, wherein the steps above all take place in the interior space of the housing, and moving the filled packing container out of the gaseous atmosphere in the housing.

2. The method as claimed in claim 1, wherein the temperature of the gaseous atmosphere is selected from a group consisting of more than 100° C., more than 120° C., more than 140° C., more than 160° C., more than 180° C. and more than 220° C.

3. The method as claimed in claim 1, wherein the gaseous atmosphere is at ambient pressure, reduced pressure or elevated pressure.

4. The method as claimed in claim 1, wherein the gaseous atmosphere is a mixture of a first component, consisting of air and/ or another gas, and water vapour as a second component, and, at least in a horizontal sub-layer, has a steam content selected from a group consisting of at least 50% by weight, at least 60% by weight, at least 70% by weight, at least 80% by weight, at least 90% by weight, at least 95% by weight, at least 98% by weight and at least 99% by weight.

5. The method as claimed in claim 1, wherein the gaseous atmosphere in at least one horizontal partial layer has an oxygen content selected from a group consisting of less than 15% by volume, less than 10% by volume, less than 8% by volume, less than 5% by volume, less than 2% by volume and less than 1% by volume.

6. The method as claimed in claim 1, wherein the gaseous atmosphere is stratified in the vertical direction, with the temperature rising and the oxygen content dropping, towards the top.

7. The method as claimed in claim 1, wherein the material is dried for a predetermined time before packing by dwelling in the gaseous atmosphere.

8. The method as claimed in claim 1, wherein the material is packed in a tin or a screw-topped jar.

9. The method as claimed in claim 1, wherein the material is packed in a film pouch pack.

10. The method as claimed in claim 9, wherein the film pouch pack is formed, filled and sealed inside the gaseous atmosphere, starting from a web of film, by means of a forming, filling and sealing apparatus.

11. The method as claimed in claim 1, wherein volatile substances escaping from the material are extracted from the gaseous atmosphere.

12. The method as claimed in claim 1, wherein that the gaseous atmosphere present within the housing is mixed and vertical stratification is avoided.

13. An apparatus for packing a material in a packing container, comprising:

a single housing for receiving a gaseous atmosphere with superheated steam, the housing surrounding an interior space which is enclosed on all sides, the housing having an inlet port and an outlet port, a means for generating a gaseous atmosphere with superheated steam inside the housing, a means for introducing into the housing a packing container having an open end and which is positioned such that the open end is facing downward to allow ambient air to flow out and gaseous atmosphere to flow in prior to filling, a means for rotating the packing container by 180°, a packing apparatus inside the housing for packing the material in a packing container, a first transport means for transporting the material through the inlet port into the housing and to a packing apparatus, a second transport means for transporting the filled packing container from the packing apparatus through the outlet port and out of the housing, wherein the packing apparatus, and first and second transport means are located within the interior space of the housing.

14. The apparatus as claimed in claim 13, wherein the first and second transport means are independent of one another or formed by part-areas of one and the same transport means.

15. The apparatus as claimed in claim 13, wherein the inlet port is on the same level as the outlet port.

16. The apparatus as claimed in claim 13, wherein the inlet port is disposed at a free end of an inlet duct which extends downwards from the housing.

17. The apparatus as claimed in claim 13, wherein the outlet port disposed at a free end of an outlet duct which extends downwards from the housing.

18. The apparatus as claimed in claim 16, wherein a vent line communicates with the housing and has an exit aperture at a height (h0) below the housing and above the inlet and outlet ports, ending in the surroundings.

19. The apparatus as claimed in claim 13, wherein an extraction line communicates with the housing and is conducted via a fan to a condenser.

20. The apparatus as claimed in claim 13, wherein the first transport means has steam-permeable trays in which the material is held.

21. The apparatus as claimed in claim 13, wherein along a partial section of the first transport means there is disposed a conduit subjected to over-pressure or under-pressure, which communicates with the housing, especially the lower portion thereof.

22. The apparatus as claimed in claim 21, wherein a flow guide or sealing means is disposed between the conduit and the partial section of the first transport means in order to ensure that there is a flow through the transport means, especially the trays.

23. The apparatus as claimed in claim 13, wherein the packing apparatus is designed as a forming, filling and sealing apparatus for pouches.

24. The apparatus as claimed in claim 13, wherein the packing apparatus is designed as a filling and sealing apparatus for tins or screw-topped jars.

25. The apparatus as claimed in claim 13, further including an extraction unit for extracting volatile substances from the gaseous atmosphere.

26. The apparatus as claimed in claim 13, wherein there is a circulation fan disposed in the housing.

27. The apparatus as claimed in claim 13, wherein there is a centrifugal cyclone separator with a fan disposed in the housing to clean the content of the housing.

28. The apparatus as claimed in claim 27, wherein the centrifugal cyclone separator is arranged in series with a flow guide or steam guide means and optionally with one or more fans.

* * * * *

UNITED STATES PATENT AND TRADEMARK OFFICE

CERTIFICATE OF CORRECTION

PATENT NO. : 8,484,933 B2
APPLICATION NO. : 12/671621
DATED : July 16, 2013
INVENTOR(S) : Schmidt et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 92 days.

Signed and Sealed this
Eighth Day of September, 2015

Michelle K. Lee

Michelle K. Lee
*Director of the United States Patent and Trademark Office*